US007780396B2

(12) United States Patent
Hendricks et al.

(10) Patent No.: US 7,780,396 B2
(45) Date of Patent: Aug. 24, 2010

(54) AUTOMATIC CARTON STACKER/COLLATOR

(75) Inventors: Timothy W. Hendricks, Acworth, GA (US); Jeff Disrud, Acworth, GA (US); Frank Moncrief, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 908 days.

(21) Appl. No.: 11/260,347

(22) Filed: Oct. 27, 2005

(65) Prior Publication Data

US 2007/0098540 A1 May 3, 2007

(51) Int. Cl.
*A01D 90/08* (2006.01)
*B65H 31/30* (2006.01)

(52) U.S. Cl. ..... 414/802; 414/790; 414/790.3; 414/789.4; 414/788.6

(58) Field of Classification Search ..... 414/788.3, 414/788.6, 789.1, 789.7, 789.979, 790, 790.3, 414/801, 790.1, 790.8
See application file for complete search history.

(56) References Cited

U.S. PATENT DOCUMENTS 3,595,568 A * 7/1971 Roskam et al. ..... 271/188
4,721,295 A 1/1988 Hathaway
5,190,281 A * 3/1993 Cardenas ..... 271/198
6,543,989 B1 * 4/2003 Derenthal et al. ..... 414/790
6,641,358 B2 * 11/2003 Schmidt et al. ..... 414/801

FOREIGN PATENT DOCUMENTS

EP 0 550 758 A1 7/1993
GB 2 036 702 A 7/1980
JP 57-189964 11/1982

* cited by examiner

*Primary Examiner*—Gregory W Adams
(74) *Attorney, Agent, or Firm*—Womble Carlyle Sandridge & Rice, PLLC

(57) ABSTRACT

A system for automatically forming stacks of cartons for feeding a magazine for supplying cartons to a packaging machine includes a primary support on which the stacks of cartons are formed, and a secondary support for temporarily receiving a series of the cartons thereon as a previously formed stack of cartons is removed from the primary support. The stack of cartons collected on the primary support is moved onto a transport conveyor for transport to a loader for the magazine for feeding into the packaging machine.

8 Claims, 7 Drawing Sheets

AUTOMATIC CARTON STACKER/COLLATOR

FIELD OF THE INVENTION

The present invention generally relates to packaging machinery, and in particular, the present invention relates to a system and method for automatically receiving, stacking, and collating a series of cartons into bundles or stacks for feeding into a packaging machine for wrapping products with the cartons.

BACKGROUND OF THE INVENTION

Typically, in the product packaging industry, such as in the beverage-bottling field, a series of products are passed through a packaging machine wherein groups of products are segmented and wrapped with paperboard cartons. For example, a series of beverage cans can be passed through the packaging machine and wrapped with paperboard cartons in six, eight, twelve, twenty-four pack configurations, and other pack sizes or configurations. The wrapped products generally then are conveyed further downstream to packaging and palletizing for shipping. Typically, the cartons are preprinted paperboard strips or wraps, generally formed with locking tabs or recesses, fed into the packaging machine from a magazine or feeder. The cartons are fed individually from the feeder in time with the movement of the products through the packaging machine, so that as the products are segmented into groups, such as six packs, twelve packs, etc., each group is moved in time with a carton that is then placed over and locked about the products.

In the past, the cartons generally have been manually loaded in stacks on the magazine or feeder for loading into the packaging machine. This typically requires an operator to be present to manually pickup and load stacks of cartons from pallets or other storage means onto the magazine or feeder for the packaging machine. The machine operator thus generally must continually monitor the level or amount of cartons stacked for loading into the packaging machine so that the stack of cartons waiting to be fed into the packaging machine can be kept relatively constant to ensure the packaging machine will not run out of its supply of cartons during operation. Such a task does not, however, tend to occupy the operator's time completely, and thus simply having an operator stand by the magazine or feeder and periodically pickup, stack, collate and load new stacks of cartons onto the feeder for feeding into the packaging machine constitutes an inefficient use of the operator's time.

Typically, therefore, the operator will be charged with other tasks that they can perform while they periodically check the magazine or feeder to load additional stacks of cartons onto the feeder as needed. If, however, the operator fails to keep up with the supply of cartons on the magazine or feeder for the packaging machine, the supply of cartons could run out, thus requiring the packaging machine to be shut down and re-primed, resulting in a costly downtime and lost production. In addition, many of the operations in a packaging facility are now highly automated, including the packaging of the products within their carton wraps, as well as the depalletizing and transport of the cartons to the packaging machine. It is accordingly desirable to try to further reduce the amount of manual operations required for the operation of the packaging line to the fullest extent possible, to increase efficiency and lower costs, and to try to reduce risks of workplace injuries such as repetitive strain injuries.

SUMMARY OF THE INVENTION

Briefly described, the present invention generally relates to a system and method for automatically stacking and collating articles such as carton blanks, sheets, or other stackable articles. The stacker/collator system generally includes a frame having an upstream or inlet end and a downstream or discharge end at which one or more transport conveyors can be positioned for transport of stacks of articles away from the stacker/collator. The articles to be stacked typically are received in series, moving at varying rates along a path of travel, at the inlet end of the frame, upon a primary support. The primary support generally includes a support plate or platform on which the articles are received and stacked. The support plate is mounted on a pivot assembly that includes a pivot rod attached to a lower surface of the support plate, and a drive mechanism for rotating the pivot rod and thus the support plate to reorient the stacks of cartons thereon. The drive mechanism for the pivot assembly of the primary support generally can include a gear attached to the lower end of the pivot rod, a rack engaging the gear, and a cylinder or motor for moving the rack to cause rotation of the primary support.

The primary support is mounted on an elevator or moveable support table that moves the primary support in a direction substantially transverse to the path of travel of the incoming articles, between a first or raised loading position and a second, lowered or discharge position. The elevator or support table generally is supported by a series of travel screws or jack rods that are driven by a motor, cylinder, or other, similar drive to move the primary support between its raised, loading position and lowered, discharge position. As the articles are received on the primary support, the primary support is progressively lowered so that the articles are accumulated in stacked series thereon.

In addition, a series of guide rods are mounted about the upper surface of the support plate of the primary support. The guide rods can be telescoping guide rods having a lower portion mounted to the support plate of the primary support and which can telescope into an upper portion or sleeve attached to an upper plate of the frame of the stacker/collator. The guide rods can be arranged in varying configurations according to the configurations of the articles to be stacked, with the articles generally being urged or directed against the guide rods to assist in collating and forming/aligning the stacks of articles being formed on the primary support.

The movement of the primary support between its raised and lowered positions typically is monitored by one or more sensors, such as proximity sensors, photoelectric eyes, or other sensors, to prevent over-travel of the primary support beyond its loading and discharge positions. Such sensors can include proximity sensors, photoelectric eyes, or other, similar types of sensors. In addition, upon detection of the accumulation of a stack of articles of a sufficient number or height or movement of the primary support to its lowered position, a secondary support can be moved from a retracted position to an extended position projecting into the path of the incoming articles for temporarily collecting or stacking the articles thereon, while the stack of articles on the primary support is transferred to the transport conveyor. The secondary support can include a support plate on which the articles are temporarily received, and which can be moved by a cylinder or similar drive mechanism between its extended and retracted positions.

A pusher assembly is mounted at the upstream or inlet side of the frame of the stacker/collator system and generally includes a pusher plate mounted on a longitudinally extensible support, which is driven across the primary support by a cylinder, servomotor, or similar drive mechanism. The pusher plate engages and pushes the accumulated stack of cartons from the support plate onto the transport conveyor, which typically transports the stack of articles to a magazine loader or magazine for a packaging machine. Thereafter, as the primary support is returned to its receiving position, the secondary support is retracted, depositing the articles collected thereon onto the primary support so that the stacking operation can be continued substantially without interruption.

Various objects, features and advantages of the present invention will become apparent to those skilled in the art upon a review of the following detailed description, when taken in conjunction with the accompanying drawings.

DETAILED DESCRIPTION OF THE INVENTION

Figure 1:
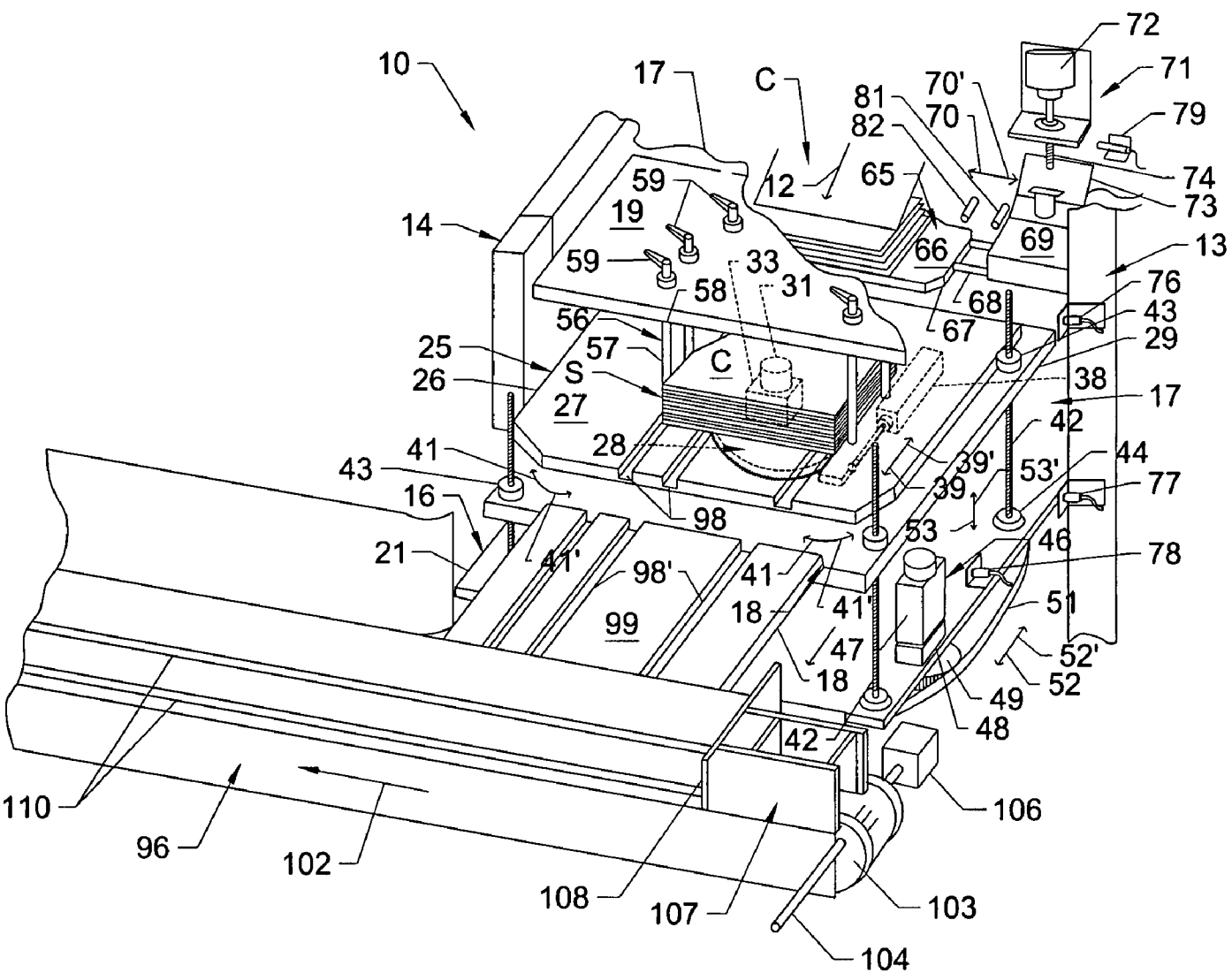
FIG. 1 is a perspective view of the stacker/collator system of the present invention.

Referring now to the drawings in greater detail in which like parts indicate like numerals throughout the several views, FIGS. 1-5E illustrate an automatic stacker set/collator system 10 and method of operation thereof for stacking and collating articles such as cartons "C" in stacks "S" or groups for feeding to a product packaging machine, or other similar downstream system. It will be understood by those skilled in the art that while the articles being stacked and collated are discussed in the following description as being cartons or boxes in which articles such as beverage cans, etc, can be packaged, various other types, sizes and configurations of products also can be stacked and collated using the present invention.

In general, the stacker/collator 10 of the present invention typically can be positioned at or adjacent the downstream end of an article processing system or machine, such as a folder/gluer for cartons, in which printed cardboard webs are formed into paperboard cartons for use in packaging various types of containers or other products therein. The cartons will be received from the folder/gluer or similar upstream equipment typically via an in-feed conveyor 11 (FIG. 2) that moves the cartons C along a path of travel (indicated by arrow 12) into the stacker/collator 10.

Figure 2:
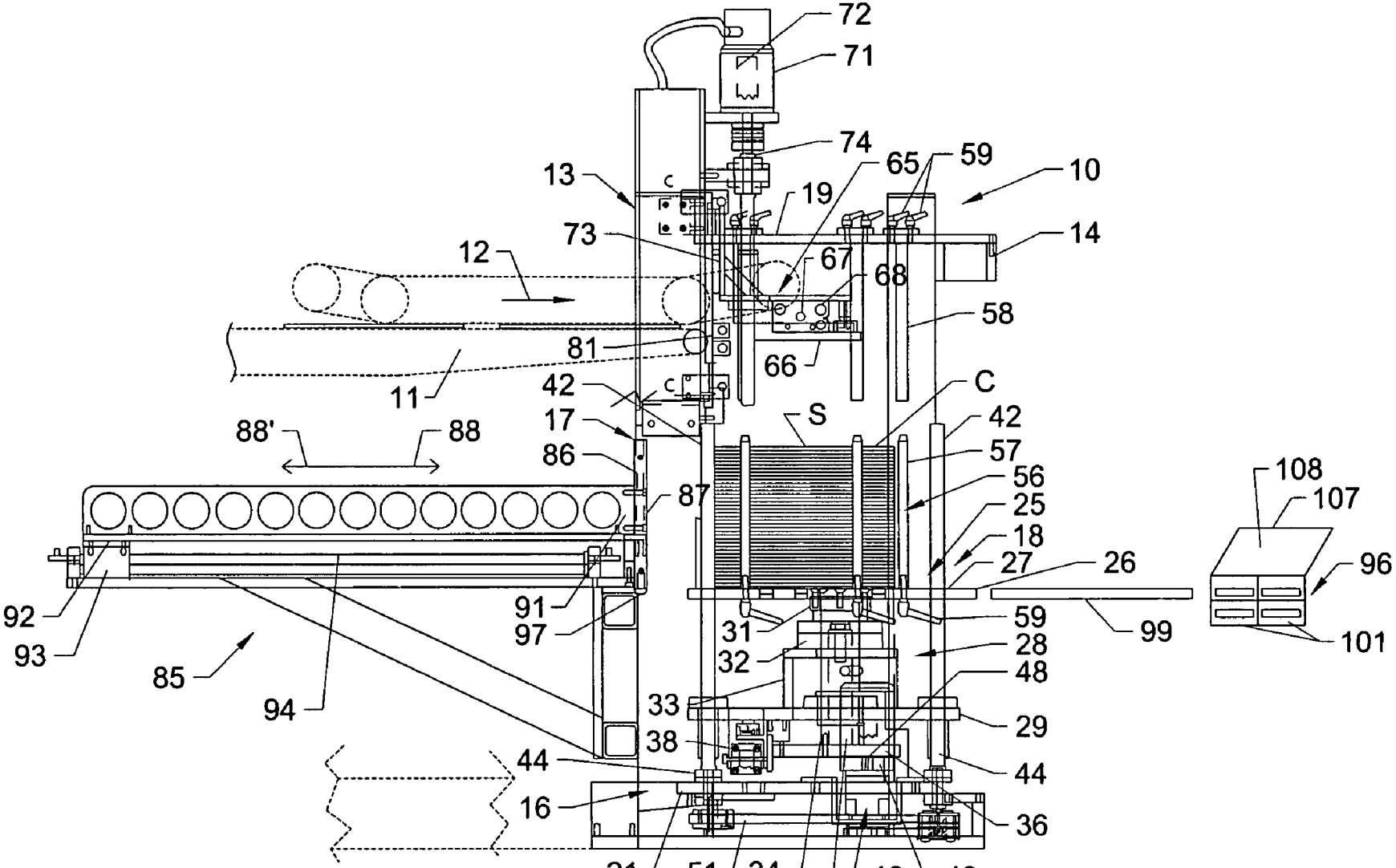
FIG. 2 is a side elevational view of the stacker/collator system of FIG. 1.
Figure 3:
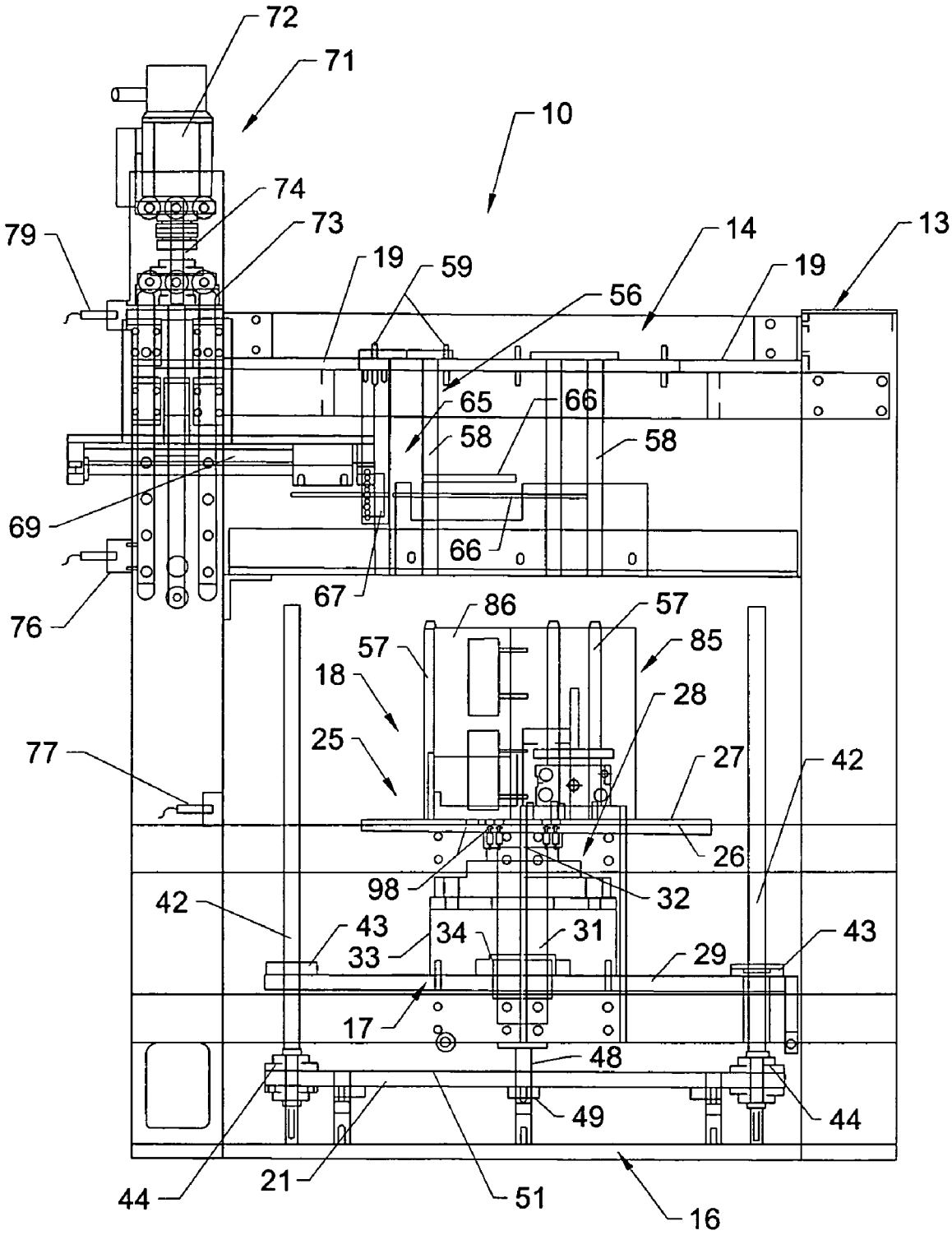
FIG. 3 is an end view of the stacker/collator system of the present invention.

As generally illustrated in FIGS. 1-3, the stacker/collator 10 includes an upstanding frame 13 having an upper portion 14, lower portion 16, an upstream, first or inlet side 17, and a downstream, second, or discharge side 18. The frame further generally will include a top or upper plate 19 defining the upper portion 14 of the frame and a lower or bottom plate 21. A primary support 25 is positioned between the upper and lower plates 19 and 21 and is moveable between a raised, first or initial position for receiving cartons thereon and a lowered, second or discharge position, such as indicated in FIG. 2, for discharging an accumulated stack S of cartons C therefrom.

The primary support 25 generally includes a support plate 26 that can be formed from a non-stick material such as metal or plastic, and typically is a substantially square or rectangular plate having a length and width greater than the length and width of the cartons to be received thereon, as indicated in FIGS. 1 and 2. It will, however, be understood that various other sizes or configurations of the support plate of the primary support 25 also can be used, depending on the type, size and/or configuration of the articles to be received and stacked thereon. The support plate 26 has a flat upper surface 27 on which the cartons are stacked, and generally is received and supported on a pivot assembly 28 that is mounted on an elevator 29 or support table for moving the primary support 25 between its raised and lowered positions.

Figure 4:
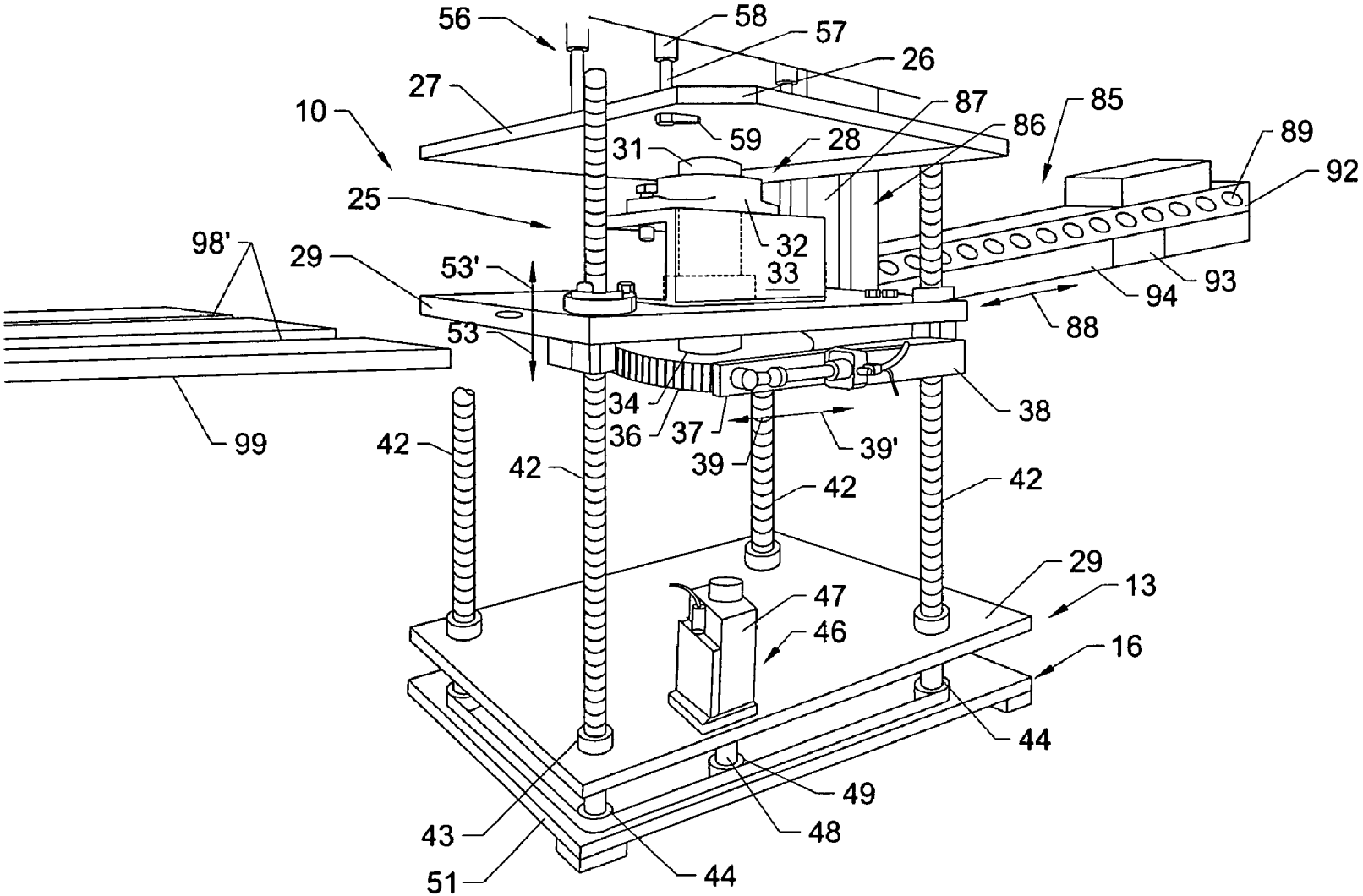
FIG. 4 is a perspective view of the pivot assembly and drive for the elevator of the primary support of the stacker/collator of FIG. 1-3.

As generally illustrated in FIGS. 2-4, the pivot assembly 28 generally includes an upstanding pivot or support rod 31 on which the support plate 26 is mounted, which pivot rod extends downwardly through a bearing assembly 32 and a support housing 33 to a distal or lower end 34. A gear, toothed wheel or sprocket 36 typically is mounted to the distal end 34 of the pivot rod 31 (as indicated in FIGS. 1 and 4). A rack 37 is positioned adjacent and in tangential engagement with the gear 36. The rack is connected to a drive such as a pneumatic or hydraulic cylinder 38 (shown in dashed lines in FIG. 1), although various types of motors, linear actuators, or other, similar drive mechanisms also can be used for moving the rack longitudinally in the direction of arrows 39 and 39' (FIG. 4). As the rack is driven linearly in the direction of arrows 39 and 39', engagement of the teeth of the rack with the teeth of the gear 36 generally causes rotation of the pivot rod 31, and thus rotation of the support plate 26, in the direction of arrows 41 and 41', for reorienting a stack(s) of cartons C in a desired direction. Alternatively, instead of the rack 37, the pivot assembly 28 could also include a chain or belt drive including a chain or belt engaging the gear 36 or the pivot rod 31 directly. Additionally, the cylinder 38 could be replaced with a motor that could drive a belt or chain or that could be directly coupled to and thus directly drive the pivot head 31 for pivoting the support plate 26.

As generally illustrated in FIGS. 1-4, the elevator 29 for moving the primary support 25 between its raised and lowered positions can be supported on a series of travel screws or jack rods 42. The travel screws 42 typically are mounted in series about the periphery of the elevator 29, for example, at the corners thereof, as illustrated in FIGS. 1-4. The travel screws extend through and are attached to the elevator by a series of bearing assemblies 43. As the travel screws 42 are rotated, the elevator 29 is raised and lowered so as to thus move the primary support 25 between its raised, initial, or home position and its lowered, secondary, or discharge position. As discussed more fully below, the travel screws generally are rotated to progressively move the primary support downwardly from its initial home position to its lowered, discharge position as the cartons are stacked or accumulated thereon.

As further illustrated in FIGS. 1, 2, and 4, the lower ends of the travel rods 42 extend through the bottom or lower plate 21 of the frame, and typically each will have a gear or pulley 44 attached thereto. A drive assembly 46 is mounted on the lower plate 21 and generally includes a drive motor 47 (FIGS. 1 and 4), which can include a servomotor, stepper motor, AC or DC motor, or other similar drive, and includes a drive shaft 48 (FIG. 2) that extends downwardly through the lower plate 21. A gear or pulley 49 is attached to the distal end of the drive shaft 48, and a drive belt 51 is extended about the drive gear or pulley 49 and the each of the gears 44 (FIG. 4) attached to each of the distal ends of the travel screws 42. As a result, as the motor rotates its drive gear, the drive belt translates this motion to each of the travel screws. As the drive belt is moved in the direction of arrows 52 and 52', the travel screws are rotated so as to cause the vertical movement of the elevator, and thus the primary support, in the direction of arrows 53 and 53' to raise and lower the primary support between its raised, initial position and lowered, discharge position.

As further generally illustrated in FIGS. 1 and 2, a series of guide rods 56 can be mounted in spaced series within and extending through the space between the upper plate 19 and the support plate 26 of the primary support 25. The guide rods can be telescoping guide rods having a lower or base portion 57 that generally is mounted to and extends outwardly from the support plate 26, and upper portions or sleeves 58 that are mounted to the upper plate 19 of the frame, with the lower portions 57 of the guide rods being slidably received therein as the support plate is moved toward and away from the upper plate 19 during movement of the primary support between its raised and lowered positions. The guide rods can be arranged in a variety of different configurations and locked in to position with clamps or locking rings 59, as indicated in FIGS. 1 and 2. The configuration of the guide rods generally is selected to substantially correspond to the configuration or shape and size of the cartons being stacked on the primary support and can be varied as needed. As the cartons are fed from the in-feed conveyor 11 onto the support plate of the primary support, the cartons typically will be urged into contact with and between the support rods so that the cartons will be substantially collated and/or aligned as they are accumulated in stack(s) on the support plate of the primary support.

As further generally illustrated in FIGS. 1-3, a secondary support 65 is mounted above and adjacent the support plate 26 of the primary support 25. The secondary support 65 generally includes an elongated support plate 66 attached to and supported along a rear side edge portion by a bracket 67 attached to one or more cylinder rods 68 (FIG. 1) of a cylinder 69. The cylinder, which also can include a rod-less cylinder having one end attached to the support plate 66, moves the support plate 66 between a retracted, non-engaging position and an extended, engaging position within the path of travel of the cartons as indicated in FIGS. 1 and 5A-5E by moving the plate in the direction of arrows 70 and 70'. The support plate 66 is moved into its extended position for temporarily receiving cartons thereon after a sufficient size stack or number of cartons have been accumulated on the primary support and/or the primary support has been lowered to its discharge position for discharging the stack of cartons therefrom. Thus, the flow of cartons from the folder/gluer can be continued without substantial interruption as a completed stack of cartons is discharged from the primary support. The secondary support 65 further is raised and lowered in timed relation with the movement primary support 25 by a drive system 71 to facilitate the continued stacking of the cartons thereon. The drive system 71 includes a drive motor 72 attached to the secondary support by a support bracket 73 and a jack, rod, or screw 74.

As further indicated in FIGS. 1-5E, movement of the primary support between its raised and lowered positions generally can be controlled through a series of sensors 76 and 77 mounted at vertically spaced locations along the frame of the stacker/collator 10. The sensors typically will include proximity sensors, although the sensors can also include photoelectric eyes, laser, or other, similar types of sensors for detecting movement of the primary support plate or elevator between its raised and lowered positions. For example, the lower sensor 77 can be used to detect when a sufficient number of cartons or a carton stack of a sufficient height has been formed on the support plate of the primary support. In response, the sensor can signal the system of the stacker/collator to engage the secondary support so that its support plate 66 will be extended outwardly in the path of travel of the cartons, while the primary support is further lowered and rotated to its discharge position/orientation. The flow of cartons further can be slowed as needed or desired, so that the cartons no longer will accumulate on the primary support, but rather will temporarily be accumulated on the secondary support as the previously formed stack of cartons is discharged from the primary support. In addition, upper sensor 76, a bottom sensor 78 mounted on plate 21 (FIG. 1), and a secondary support sensor 79 generally can act as over-travel sensors to prevent movement of the primary and secondary supports beyond their raised, home position and/or lowered, discharge positions.

In addition, as generally indicated in FIGS. 1, 2 and 5B-5E, sensors 81 and 82 further can be provided adjacent the secondary support for monitoring the position of the support plate 66 and/or the cylinder rods 68 so as to control the movement of the support plates 66 between its extended and retracted positions. The sensors 81 and 82 can be proximity sensors, photoelectric eyes, or other, similar types of sensors for detecting the position and/or movement of the support plate to ensure that the support plate will be fully extended and/or fully retracted as needed.

Figure 5A:
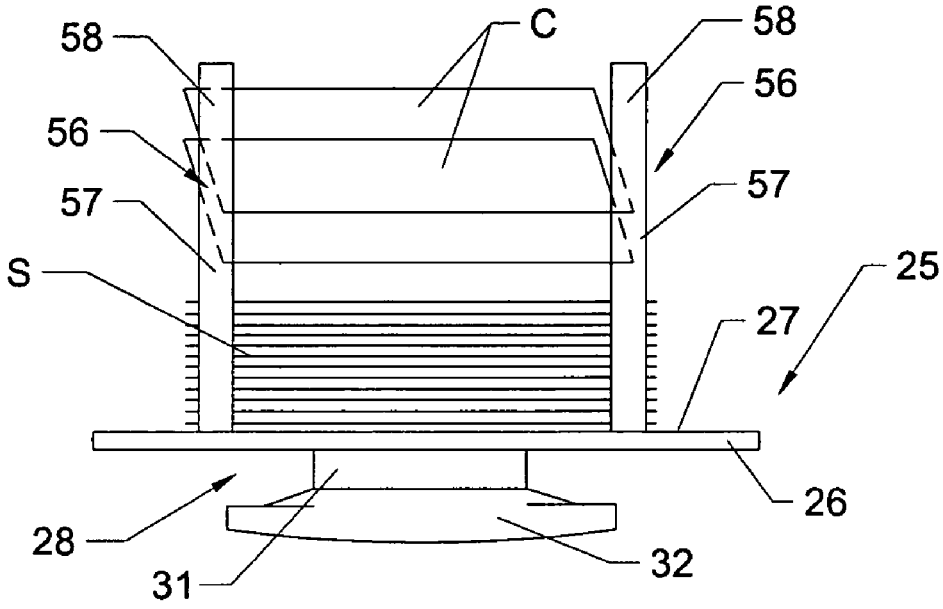
FIG. 5A-5E are schematic views illustrating an example embodiment of the process of the present invention by which a series of cartons is stacked and collated, and the stack of cartons thereafter transferred to a transport conveyor.
Figure 5B:
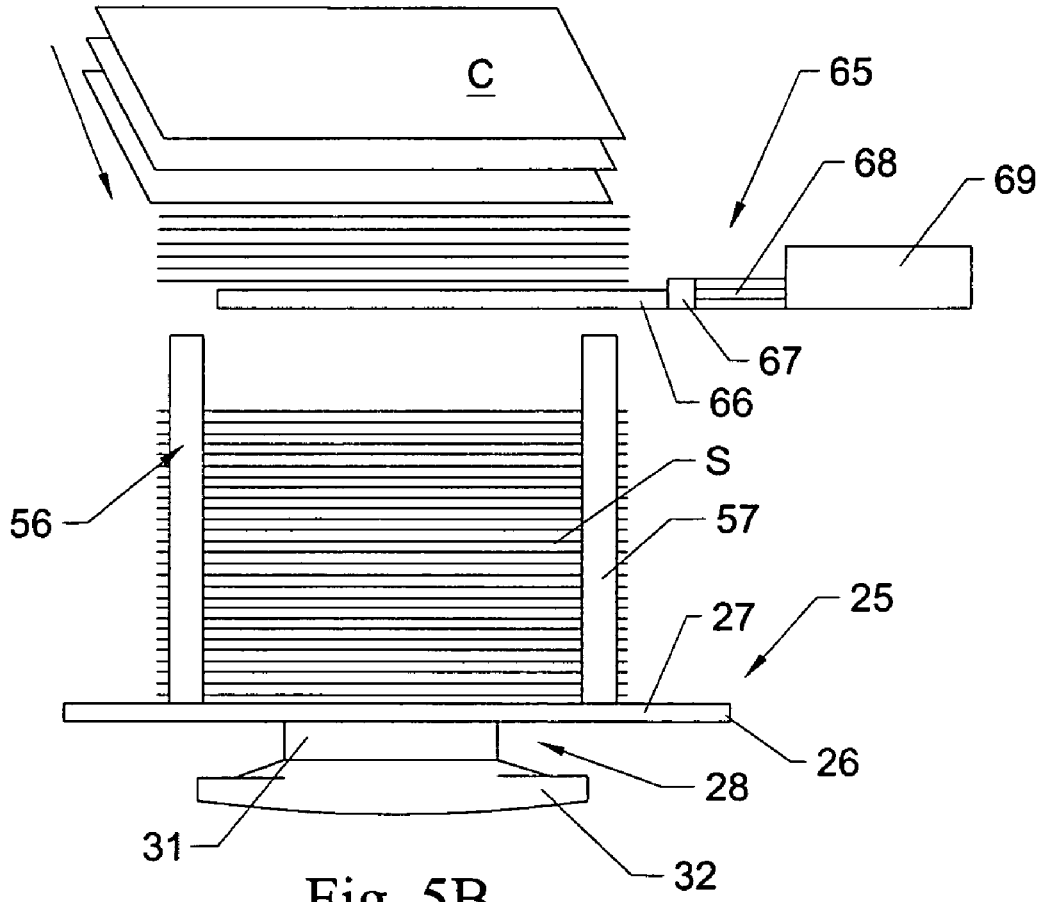
Figure 5C:
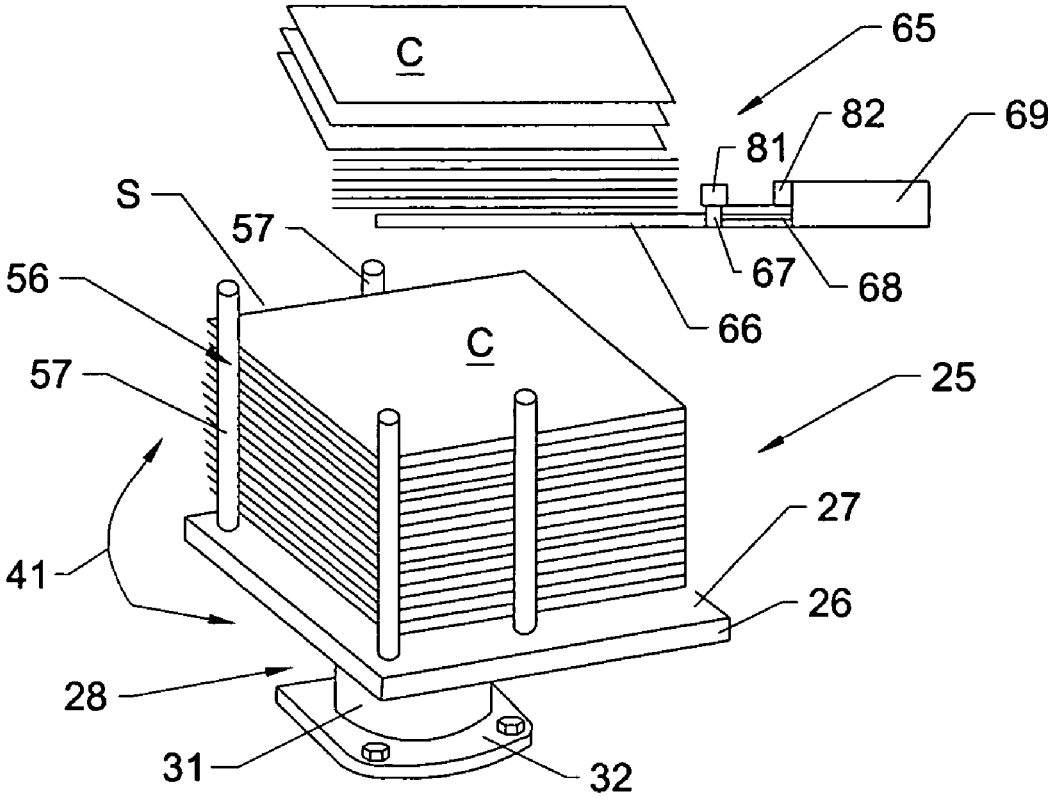
Figure 5D:
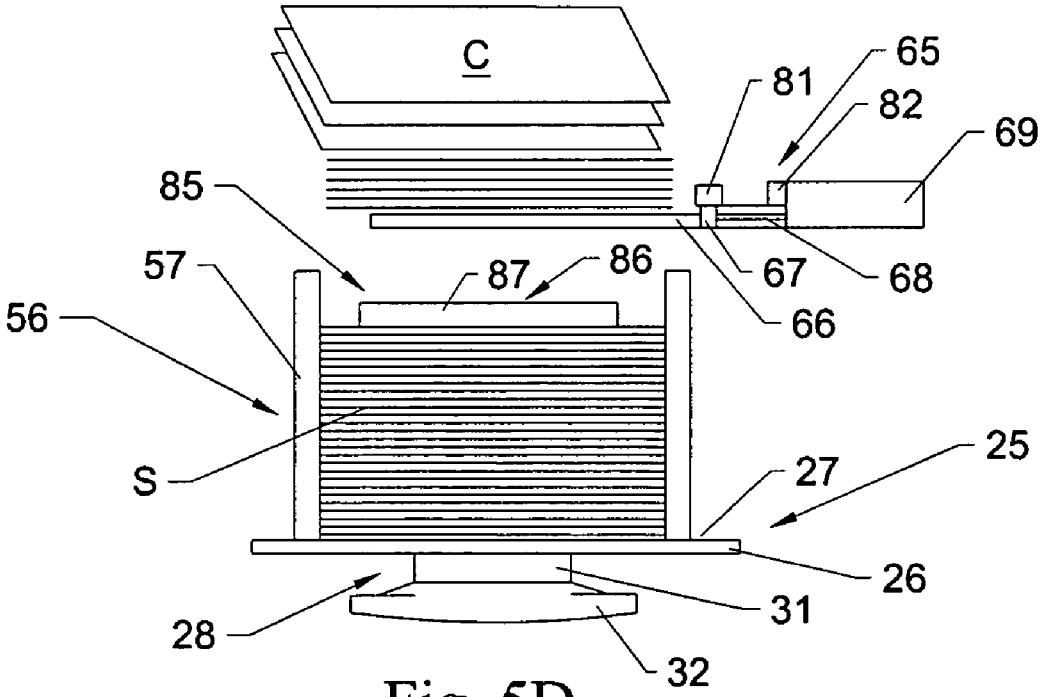
Figure 5E:
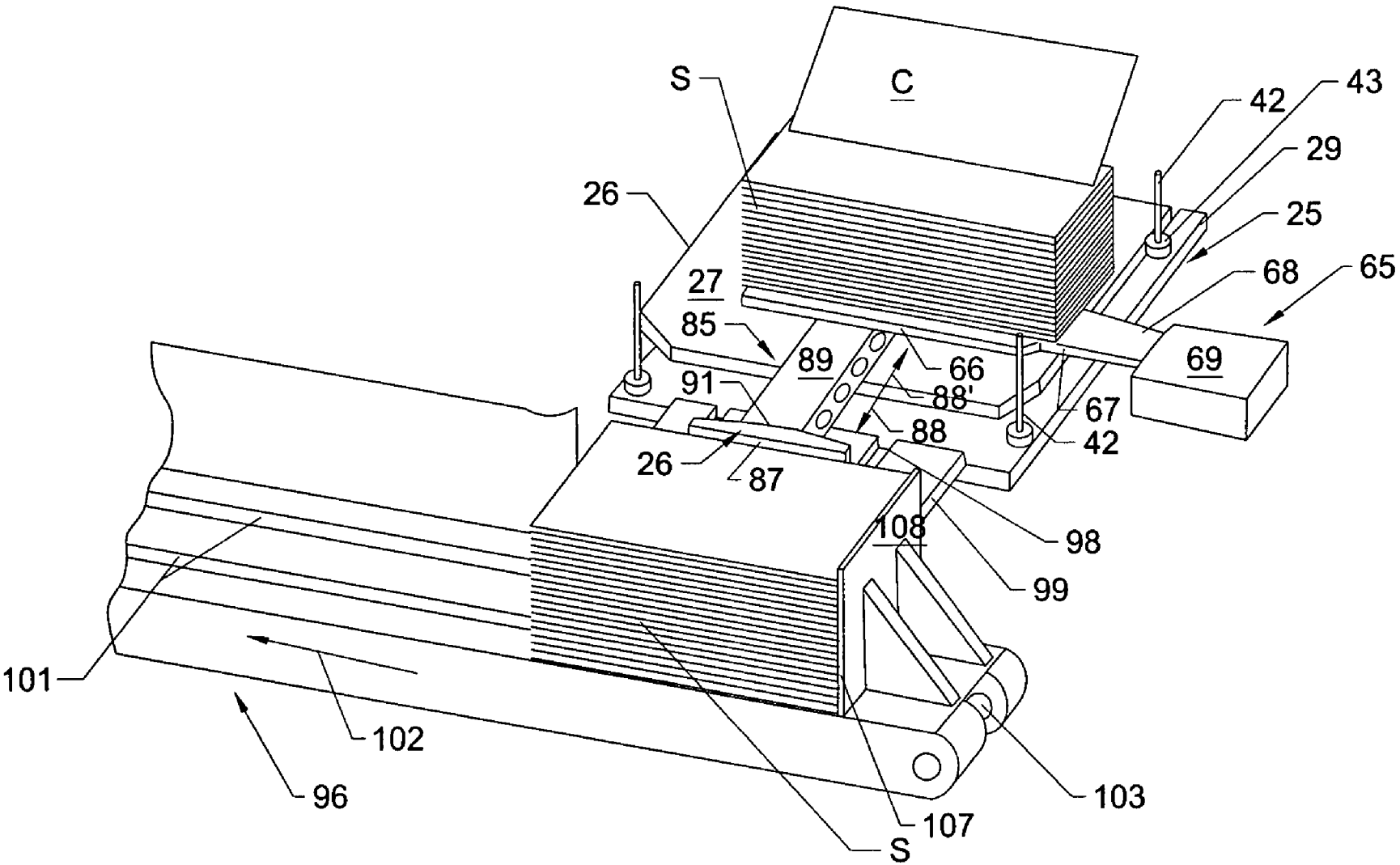

As generally illustrated in FIGS. 2, 4 and 5E, a pusher assembly 85 is mounted along the upstream side 17 of the frame 13 of the stacker/collator 10. The pusher assembly generally includes a vertically oriented pusher plate 86 that typically is made from a non-stick plastic material such as Delrin, or other, similar material, and has a forwardly facing engaging surface 87 (FIG. 2) that engages the stack of cartons collected on the primary support forwardly as the pusher plate is extended in the direction of arrows 88 to push the stack S of cartons C off of the support plate 26 of the primary support 25 as indicated in FIG. 5E. As shown in FIG. 2, the pusher assembly further includes an elongated support rod or beam 89, having a first end 91 attached to the pusher plate 86 and a second end 92 mounted to a slide or carrier 93 of a cylinder 94. The cylinder 94 generally is an elongated rod-less cylinder that conveys the carrier 93 in the direction of arrows 88 and 88' so as to cause the pusher plate to move forwardly and across the upper surface of the support plate to urge the stack of cartons on the support plate off of the support plate and onto a waiting transport conveyor 96 as indicated in FIGS. 2 and 5E. The cylinder 94 can also be replaced with other, alternative drive mechanisms such as various types of cylinders and/or motors, such as servo, stepper motors, or further with linear actuators or other similar types of drive systems. The cylinder typically can be actuated upon detection of the primary support being moved and rotated to its lowered, discharge position with the stack of cartons having been reoriented for discharge onto the transport conveyor 96.

As generally illustrated in FIGS. 1 and 4, the pusher plate 86 also generally can include a series of protrusions, tongues or projections 97 extending downwardly from the lower surface thereof. The protrusions 97 generally will be received in and ride along guide channels or slots 98 (FIG. 1) formed in the upper surface of the support plate 26 of the primary support 25. The support plate 26 is shown in FIG. 1 with approximately three slots, although additional or lesser slots also can be provided, as well as the slots being provided with different spacings or configurations as needed for urging different sizes and/or configurations of cartons off the primary support. Still further, as illustrated in FIG. 1, a guide or extension plate 99 having corresponding slots 98' formed thereon can be positioned between the primary support and transport conveyor 96, positioned approximately in line with the lowered, discharge position of the primary support, depending upon the spacing between the frame of the stacker/collator and the transport conveyor. Alternatively, the extension plate 99 can be eliminated and the cartons transferred directly from the support plate to the transport conveyor depending upon space considerations.

As generally illustrated in FIGS. 1 and 5E, the transport conveyor 96 generally is a chain type conveyor, although other types of conveyors such as belt conveyors, etc. can be used. The transport conveyor 96 includes one or more conveyor chains 101 extending in the direction of arrow 102 about pairs of drive sprockets 103 for conveying stacks of cartons away from the stacker/collator in the direction of arrow 102. As illustrated in FIG. 1, at least one pair of drive sprockets 103 will be attached to a drive rod or axel 104, connected to a drive motor 106. A pusher or carrier 107 is attached to the drive chains 101 to be moved in the direction of arrow 102 with the rotation of the drive chains. The carrier 107 includes an upstanding plate 108, typically formed from a non-stick, non-skid material such as a Delrin or other, similar type of plastic material for pushing the stack of cartons in the direction of arrow 102 as indicated in FIG. 5E for transport of the cartons to a magazine of a packaging machine (not shown). Alternatively, while only a single transport conveyor is illustrated, it will be understood that at least one additional transport conveyor also can be provided, typically extending in a different direction, so that the stacks of cartons can be fed to multiple transport conveyors for feeding multiple product packaging machines.

Referring now to FIGS. 5A-5E, the method of operation of the stacker/collator of the present invention is generally illustrated. Typically, at the start of a stacking operation, the primary support 25 will be raised to its loading position for receiving a flow of cartons C in stacked series thereon. As an alternative, the temporary support 65 can be initially extended to receive the cartons as the primary support is being moved to its raised position. As indicated in FIG. 5A, as the cartons thereafter are received on the support plate 26 of the primary support 25, the primary support is progressively lowered so that the cartons are accumulated thereon to form a stack S. Once a sufficient stack of cartons has been accumulated on the support plate of the primary support as indicated by movement of the primary support to a lowered position, such as detected by sensor 77 (FIG. 1), the control system of the stacker/collator will engage the cylinder 69 of the secondary support 65 so as to move the support plate 66 forwardly to its extended position into the path of travel of the incoming cartons.

As the support plate of the secondary support is being moved into its extended position, the flow of cartons typically will be slowed and/or can be briefly halted as needed or desired to facilitate the movement of the support plate to its extended position without substantially interfering with the next carton(s) being fed into the stacker/collator and/or causing a jamming or mis-feed of the incoming cartons. As generally illustrated in FIG. 5B, as the continued flow of cartons is collected on the secondary support, the primary support is reoriented, as illustrated in FIG. 5C by the engagement and movement of the rack with the gear attached to the pivot rod support for the primary support. As a result, the stack of cartons is reoriented to a position for being discharged from the primary support as indicated in FIGS. 5C and 5D.

After the primary support has been pivoted or rotated to its new orientation, the pusher assembly 85 (FIG. 5E) is engaged, whereupon the pusher plate 86 is moved in the direction of arrow 88. The pusher plate engages and urges the collected stack S of cartons C off of the upper surface of the support plate of the primary support laterally in the direction of arrows 88 and onto the transport conveyor 96 as indicated in FIGS. 1 and 5E. In addition, it will be understood that the primary support can be rotated in different directions as needed to reorient the cartons for transfer to multiple, separate transport conveyors as needed or desired for supplying stack of cartons to multiple packaging machines.

Thereafter, the transport conveyor will convey the stack S of cartons away from the stacker/collator into a magazine or magazine loader for a packaging machine or for further processing or storage as desired. At substantially the same time, the pusher plate will be retracted to its initial, rest position, after which the primary support will be rotated back to its original orientation and raised to its carton receiving position. Once the primary support has been raised to its upper position, the support plate of the secondary support will be retracted, moving between a pair of the guide rods which engage and cause the cartons collected on the support plate of the secondary support to slide off as the plate is retracted. Thereafter, the feeding of the cartons into the stacker/collator can be returned to its normal or increased operating speed as the cartons continue to be collected on the primary support.

It will be understood by those skilled in the art that while the present invention has been discussed above with reference to particular embodiments, various modifications, additions and changes can be made to the present invention without departing from the spirit and scope of the present invention.

What is claimed:

1. A method of forming stacks of articles, comprising:

feeding a series of articles onto a movable primary support;

progressively moving the primary support in a direction substantially transverse to the feeding of the articles as successive ones of the articles are accumulated thereon;

upon accumulation of a desired stack of articles on the primary support, moving a secondary support into a position for receiving the articles thereon as the feeding of the articles is continued;

as the articles are received on the secondary support, adjusting a rate at which the articles continue to be fed onto the secondary support to control accumulation of the articles on the secondary support;

rotating the primary support into a desired orientation prior to moving the stack of articles off of the primary support;

moving the stack of articles off of the primary support; and returning the primary support to a position for receiving and accumulating the articles thereon.

2. The method of claim 1 and further comprising collating the articles as the articles are accumulated in stacked series on the primary support.

3. The method of claim 2 and wherein collating the articles comprises feeding the articles into contact with a series of guides arranged about the primary support.

4. The method of claim 1 and wherein progressively moving the primary support comprises lowering the primary support until detection of the movement of the primary support reaching a pre-determined elevation.

5. The method of claim 4 and wherein adjusting the rate at which the articles continue to be fed onto the secondary support further comprises slowing the feeding of the articles upon detection of the primary support reaching its pre-determined elevation to enable movement of the secondary support into a position to receive the article.

6. The method of claim 1 and further comprising receiving the stack of articles on a transport conveyor for transporting the stack of articles away from the primary support.

7. The method of claim 1 and wherein moving the stack of articles off of the support table comprises rotating the primary support, moving a pusher mechanism across the primary support to urge the stack of articles off the primary support.

8. A method of forming stacks of articles, comprising:

feeding a series of articles onto a movable primary support;

progressively moving the primary support in a direction substantially transverse to the feeding of the articles as successive ones of the articles are accumulated thereon;

upon accumulation of a desired stack of articles on the primary support, moving a secondary support into a position for receiving the articles thereon as the feeding of the articles is continued;

as the articles are received on the secondary support, adjusting a rate at which the articles continue to be fed onto the secondary support to control accumulation of the articles on the secondary support;

rotating the primary support in a first direction for moving the stack of articles onto a first transport, and alternatively rotating the primary support in a second direction for moving the stack of articles onto a second transport;

moving the stack of articles off of the primary support; and returning the primary support to a position for receiving and accumulating the articles thereon.

* * * * *